United States Patent [19]

Haltsonen et al.

[11] 4,321,109

[45] Mar. 23, 1982

[54] APPARATUS FOR CHANGING FABRICS IN PAPER MANUFACTURING MACHINES

[75] Inventors: Eino J. Haltsonen; Martti T. Oksanen, both of Jyväskylä, Finland

[73] Assignee: Valmet Oy, Finland

[21] Appl. No.: 178,517

[22] Filed: Aug. 15, 1980

Related U.S. Application Data

[62] Division of Ser. No. 66,836, Aug. 15, 1979, Pat. No. 4,267,018.

[30] Foreign Application Priority Data

Aug. 17, 1978 [FI] Finland ..... 782521

[51] Int. Cl.[3] ..... D21F 7/00

[52] U.S. Cl. ..... 162/274; 254/93 HP

[58] Field of Search ..... 162/273, 274, 199, 200; 254/93 HP; 74/242.7; 198/617, 804, 841

[56] References Cited

U.S. PATENT DOCUMENTS 3,744,756 7/1973 Smith ..... 254/93 HP

*Primary Examiner*—Peter Chin

*Attorney, Agent, or Firm*—Steinberg & Raskin

[57] ABSTRACT

An apparatus for introducing an endless fabric loop over rolls in a paper making machine in connection with changing the fabric therein comprising an inflatable changing bag which, upon being inflated, has a vertical cross-sectional configuration in the machine direction which is substantially the same as the configuration of the intended run of the fabric loop over the rolls. The changing bag is located in its deflated condition within the fabric loop which is to be introduced over the rolls whereupon the bag is inflated with the fabric loop encircling the same. The assembly of the inflated changing bag and the encircling fabric loop is located on one side of the paper machine in the region adjacent to the rolls onto which the fabric loop is to be introduced whereupon the fabric loop is moved from over the inflated changing bag onto the paper machine so that it encircles the rolls. The changing bag is preferably provided with a plurality of interior partitions which divide the bag interior into a plurality of independent airtight compartments, each of which extends in the machine direction. As the fabric loop is pulled from the changing bag onto the rolls, the compartments are successively deflated to facilitate the introduction of the fabric loop over the rolls.

4 Claims, 9 Drawing Figures

APPARATUS FOR CHANGING FABRICS IN PAPER MANUFACTURING MACHINES

This is a division, of application Ser. No. 66,836, filed Aug. 15, 1979 now U.S. Pat. No. 4,267,018.

BACKGROUND OF THE INVENTION

This invention relates generally to a method and apparatus for use in connection with the maintenance of paper machines and, more particularly, to a method and apparatus for introducing a closed fabric loop over associated rolls in the paper machine.

It is understood that in the following description, the term "fabric" is used in its most general sense to designate the various materials employed to form the endless loops in the various paper machine sections, i.e., the drying, pressing and forming sections of the paper machine. Thus, the fabric may comprise a felt used in the drying and pressing sections of the machine or wire utilized in the single or twin-wire sections of paper machines.

Various systems for changing the fabrics in paper machines are presently known. For example, seamed fabrics, such as the felt used in paper machine drying sections, are usually changed without any problem by loosening and then separating the seam of the old felt whereupon the new felt is attached with the paper machine running at a relatively slow speed whereupon the new felt is threaded through the drying section. The old felt may then be removed and the new felt seamed to form the fabric loop and appropriate tensioning operations accomplished.

Another conventional technique for changing an endless drying felt comprises unfastening the bearings on the service side of the paper machine whereupon the new felt is urged over the rolls in the axial direction relative thereto.

A conventional technique for changing the press felts in a paper machine comprises detaching the ends of the rolls located within the felt loop together with their bearing means from the machine frame on the service side of the paper machine and removing them entirely therefrom. The press sections in large paper machines are commonly provided with associated lifting apparatus whereby these rolls can be raised and supported during the felt change operation without the necessity of additional lifting equipment. Such lifting apparatus usually comprise hoists which are either directly suspended from the frame of the paper machine or, alternatively, comprise upright cranes which are supported on structures affixed to the machine servicing platform, such lifting apparatus usually being hydraulically operated.

In connection with wire-hanging systems, it is known in the prior art to utilize wire sections which are capable of being run out from the machine. Such systems include transversely extending support members located under the longitudinal beams of the wire frame, which supports are themselves supported on legs having rollers to facilitate their movement. In such wire changing systems, the entire inner structure of the wire loop can be displaced to a location beside the wire section with the exception of the cantilever-mounted traction and suction rolls. A track running transverse to the machine direction is utilized for transferring the new wire by means of a specially adapted wire carriage which comprises apparatus whereby the wire is spread out and opened over the wire pit with the aid of wire poles to thereby assume a configuration such that the inner structure of the wire loop, which has been displaced as described above, can be moved within the wire loop. The spreading of the new wire loop is accomplished in one or two manners, namely, by carrying the end bight of the wire towards the breast roll with the aid of wire pulls in which case the spreading means is fixed in the wire carriage, or by detaching the spreading means and moving it with the aid of a hoist. In a wire section provided with cantilever mounting, the transversely extending supports which carry the longitudinally extending beams of the inner structure of the wire loop are rigidly affixed to the foundation on the drive side of the paper machine. After dismantling certain elements of the paper machine and performing certain additional steps, the wire which has been dropped from the wire carriage will run to the side of the wire section and downwardly to be supported by the wire poles, can now be run into the machine to encircle the wire section. Although this conventional wire changing procedure is fast, it is disadvantageous in that the cantilever support members necessary for its operation are both heavy and expensive.

SUMMARY OF THE INVENTION

Accordingly, it is one object of the present invention to provide a new and improved method and apparatus for changing fabric loops in paper machines so that the changing of the fabric is facilitated and can be accomplished in a faster manner than is possible utilizing conventional techniques.

Another object of the present invention is to provide a new and improved method and apparatus for changing fabric loops in paper machines which are appropriate for changing both bronze as well as plastic wires and, in twin-wire sections, for changing the upper as well as the lower wire.

Still another object of the present invention is to provide a new and improved method and apparatus for changing fabrics in paper machines wherein it is necessary to slacken the rolls of the paper machine to only a minimum extent.

A further object of the present invention is to provide a new and improved apparatus for changing fabrics in paper machines, which apparatus requires only a minimal space for storage between use.

Yet another object of the present invention is to provide new and improved apparatus for changing the fabrics in paper machines which is relatively inexpensive.

One other object of the present invention is to provide new and improved apparatus for changing fabrics in paper machines wherein the fabric is supported throughout the entire changing operation over at least its upper surface so that the possibility of wrinkles being formed in the fabric, which wrinkles tend to damage the fabric, is minimized.

Briefly, in accordance with the present invention, these and other objects are obtained by providing a method and apparatus which includes the use of an inflatable changing bag which, upon being inflated, has a vertical cross-sectional configuration in the machine direction which is substantially the same as the configuration of the intended run of the fabric loop. According to the method of the invention, the changing bag is located within the fabric loop to be introduced over the rolls so that the fabric loop encircles the bag whereupon the changing bag is inflated. The resulting assembly including the inflated changing bag and the encircling fabric loop is located on one side of the paper machine in the region adjacent to the rolls onto which the fabric loop is to be introduced whereupon the fabric loop is pulled into position, i.e. so as to encircle the associated rolls while at the same time having its configuration maintained by the changing bag.

According to the present invention, the inflatable changing bag includes a plurality of vertically extending partitions which divide the bag interior into a plurality of air-tight compartments which themselves run in the machine direction. Each compartment is provided with valve means which enables the respective compartment to be deflated independently of the other compartments. In this manner, as the fabric loop is pulled from the changing bag onto the associated rolls, the compartments of the bag can be progressively deflated to facilitate the introduction of the fabric loop onto the associated rolls.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which.

DESCRIPTION OF THE PREFERRED EMBODIMENTS

Figure 1:
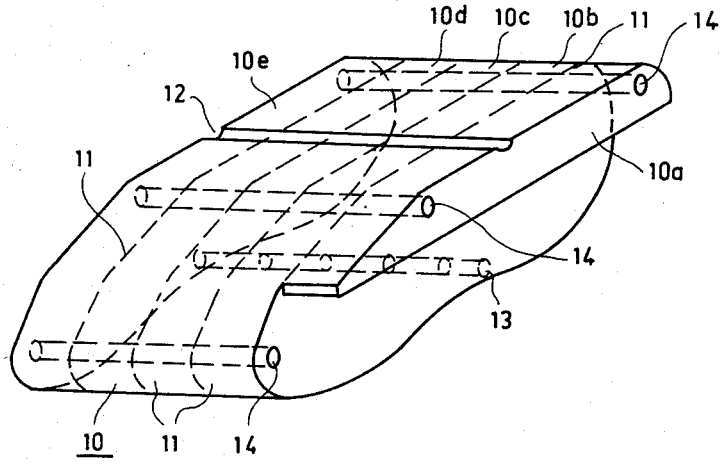
FIG. 1 is a schematic perspective view of the inflatable changing bag according to the apparatus of the present invention utilized in connection with the method of the present invention.

Referring now to the drawings wherein like reference characters designate identical or corresponding parts throughout the several views, a preferred embodiment of the method and apparatus of the present invention is illustrated in connection with the changing of a wire loop. However, it is understood that the method and apparatus of the invention are applicable in connection with changing other fabrics in a paper machine. Thus, referring to the figures, a wire changing bag 10 is formed of an air-tight flexible material such, for example, of rubber or plastic, and is preferably reinforced with a suitable fabric material. The changing bag 10 has a breadth, i.e., a cross machine dimension, which is at least equal to the width of the wire. The changing bag 10 is further constructed so that upon being inflated, it has vertical cross-sectional configuration in the machine direction which is substantially the same as the configuration of the intended run of the fabric. In other words, this cross-sectional configuration of the changing bag 10 is substantially the same as the shape which the wire loop 20 has when the rolls of the paper machine 100 are in their wire changing position.

As seen in FIGS. 1, 2, 5 and 6, the changing bag 10 is divided by a plurality of vertically extending parallel partitions 11 into mutually hermetically sealed compartments 10*a*, 10*b*, 10*c*, 10*d* and 10*c*, the compartments themselves extending parallel to each other in the machine direction as best seen in FIG. 1. Each compartment 10*a*–10*e* is provided with a valve 17 (FIG. 5) which can be opened by conventional means such, for example, as by pulling on a string. In this manner, each compartment can be separately deflated independently of the other compartments by opening the respective valve 17 provided therein. A compressed air hose (not shown) provided with an appropriate valve communicates with each compartment 10*a*–10*e* so that each compartment 10*a*–10*e* can be inflated to a desired pressure.

Figure 2:
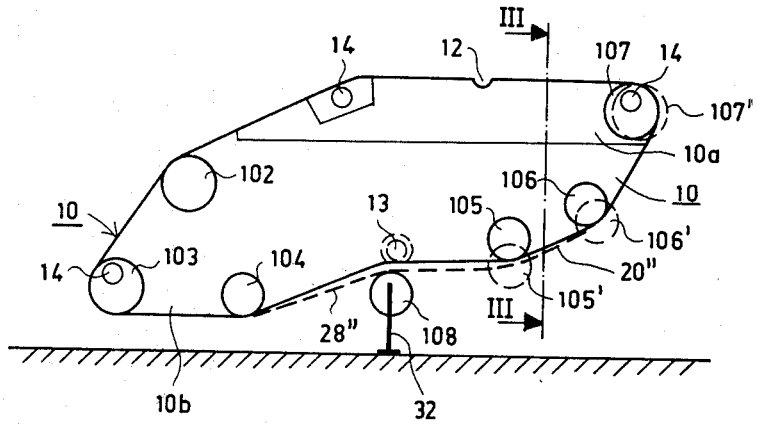
FIG. 2 is a schematic side elevation view illustrating the inflatable changing bag of FIG. 1 located adjacent to one side of the paper machine, i.e., in operating position.

As shown in FIGS. 1 and 2, a plurality of bores 14, three being provided in the illustrated preferred embodiment, extend transversely through the upper part of the changing bag 10 in a manner such that they extend horizontally when the changing bag is in its operating position, i.e., when the changing bag is located preparatory to the wire loop being introduced onto the paper machine rolls. The bores 14 are themselves each defined by an air-tight wall. Further, the upper and lower walls of the changing bag 10 have slots 12 and 13, respectively formed therein through which the wire poles can be removed as described below.

Figure 3:
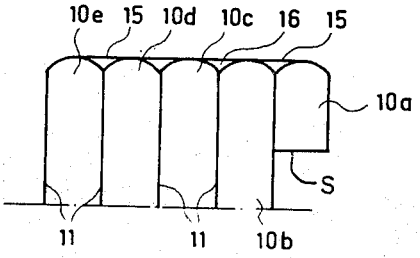
FIG. 3 is a sectional view taken along line III—III of FIG. 2.

The construction of the changing bag is best seen by reference to the cross-sectional view thereof illustrated in FIG. 3. Thus, adjacent partitions 11 are joined by curved end portions 16 over the exterior of which is provided a fabric wall 15, the latter being attached to the curved end portions 16 at their centers.

The above-described changing bag 10 is utilized in connection with one embodiment of the method of the present invention as follows. Thus, FIG. 1 illustrates the configuration of the changing bag 10 upon all of the compartments 10*a*–10*e* being inflated. The wire changing operation is initiated by cutting the old wire to be replaced and removing it from the rolls. Referring to FIG. 2, rolls 102, 103, 104, 105, 106, 107 and 108, which determine the run of the wire loop, are then moved, by means of their respective supporting means which are known per se, into a position such that the new wire loop can be introduced over them in a relatively slack condition.

Figure 4:
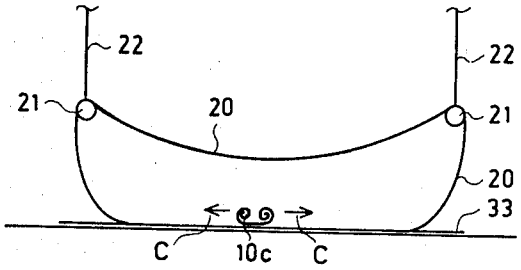
FIG. 4 is a schematic view illustrating a step in the method of the present invention wherein a fabric loop is to be introduced onto the paper machine.
Figures 7A, 7B, 7C:
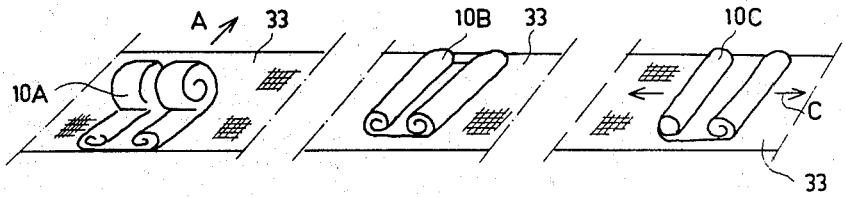
FIGS. 7A, 7B and 7C illustrate the sequence of steps whereby the inflatable changing bag is unpacked and further illustrates the space-conserving nature of the changing bag package.

Referring to FIG. 4, the new wire loop 20 which is to be introduced over the above-mentioned rolls is suspended by horizontally extending poles 21 and suspension ropes 22 over a felt 33 which has been placed on the floor adjacent to the paper machine. The changing bag 10 in a deflated and packaged condition designated 10C, is placed within the wire loop 20. More particularly, the changing bag 10 can be packaged when not in use in a manner such that a minimum of space is required for storing the same during such periods of non-use. Thus, referring to FIGS. 7A, 7B and 7C, the changing bag 10 is packaged during storage as seen in FIG. 7A, the packaged changing bag being designated 10A.

In this configuration, the bag is rolled in two directions. The bag package 10A is prepared for use by unrolling the package 10A in the direction of arrow A in FIG. 7A whereby the bag package assumes the shape designated 10B (FIG. 7B). Finally, the bag package 10B is unrolled in the directions of arrows C (FIG. 7C) in order to completely unpack the bag. The unrolling step illustrated in FIG. 7C is preferably done after locating the bag package 10C within the wire loop 20 as shown in FIG. 4.

After unpacking the bag 10 as described above, the plurality of compartments 10*a*–10*e* of the bag are then inflated in any suitable sequence whereby the bag becomes taut within the wire loop 20.

Referring to FIG. 3, it is seen that the compartment 10*a* comprising the last compartment in the transverse direction and which will be located adjacent to the side of the paper machine during the fabric loop changing operation has a decreased height relative to the other compartments 10*b*–10*e* so that a downwardly facing shelf S is defined thereby. As described below, the shelf S will be supported by appropriate supporting members 101 provided on the side of the paper machine 100 or on equivalent supporting structure.

Figure 5:
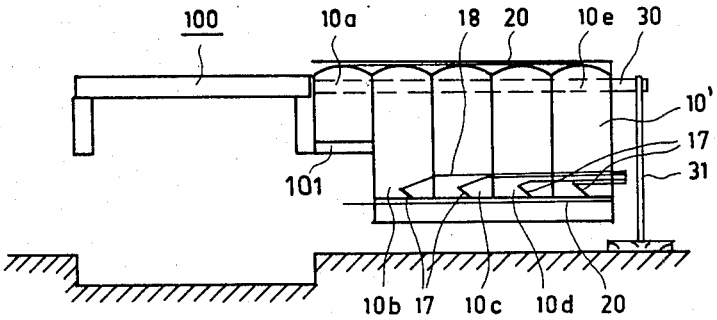
FIG. 5 is a schematic front elevation view illustrating the location of the inflatable changing bag and a fabric loop encircling the same adjacent to one side of the paper machine.

Referring to FIG. 5, the wire changing bag is supported by means of elongate members of poles 30 which extend through the bores 14 so that their end portions extend beyond the edge surfaces of the bag 10. Vertically extending support members 31 in turn support the poles 30 at their ends which are remote from the paper machine 100. As mentioned above, the shelf S rests on and is supported by the supporting member 101 provided on the side of the paper machine 100.

With the new wire loop 20 encircling the inflated changing bag, designated 10', and the latter maintaining the configuration of the wire loop 20, the wire loop 20' is pulled into the paper machine 100 to encircle the rolls 102–107 and to run over the roll 108. This pulling of the wire 20' is preferably initiated with the aid of pulling ropes (not shown) the ends of which are attached, for example, to the corners of the wire loop 20'. As the wire loop is pulled inwardly over the paper machine rolls an underside support member 32 (FIG. 2) guides the lower run of the wire loop so that this lower run assumes the position designated 20'' illustrated in FIG. 2.

As the wire loop 20' is pulled from the changing bag 10' and onto the paper machine rolls, the changing bag is at least partially deflated in a manner so as to facilitate the introduction of the wire loop over the rolls. More particularly, compartment 10*b* is initially deflated so as to assume the configuration designated 10*b'* in FIG. 6. This results in a minimization of the distance over which the wire loop 20' must slide along the surface of the bag 10' and, consequently, minimizes the forces required to remove the wire loop from the surface of the bag.

Figure 6:
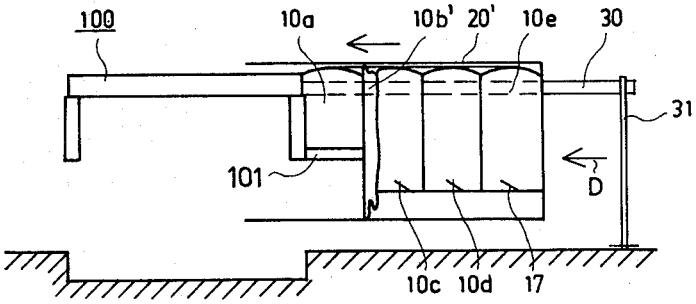
FIG. 6 is a view similar to FIG. 5 illustrating the manner in which the new fabric loop is pulled onto the paper machine.

Similarly, when the introduction of the wireloop 20' has progressed to the extent illustrated in FIG. 6, the next compartment, namely compartment 10*c* is then deflated and this procedure is continued with successive compartments being successively deflated as the introduction of the wire loop continues until, finally, the wire loop has been completely introduced over the rolls of the paper machine.

At this point, the deflated changing bag 10 and its associated supporting members are then removed from the side of the paper machine 100 whereupon the wire poles 30 are removed from the bores 14 in the bag 10'. The bag is then packaged as illustrated in FIG. 7 so that a minimum of storage space is required until the bag is again utilized. Finally, the rolls 105, 106 and 107 are moved into their operating positions 105', 106', 107' (FIG. 2) to thereby stretch the wire loop 20 into its taut operating configuration.

A particularly preferred method according to the present invention comprises inserting the poles 30 which had subsequently been located under the paper machine into the bores 14 of the changing bag 10. The changing bag 10 is then inflated with an air blower or the like to a condition where it is nearly fully inflated with the wire loop encircling the same. The changing bag and encircling wire loop is then lifted and supported by poles 30. The changing bag is then fully inflated and guide members 32 placed adjacent to the lower or outside roll 108 of the paper machine 100 so as to be located beneath the wire loop 20. The changing bag is then lowered into the wire changing position wherein it is supported on the machine side by the service platform 101 engaging the shelf S of the endmost compartment 10*a* and on the other side by support members 31. The particular construction of the endmost compartment 10*a* which defines the downwardly facing shelf S as described above is particularly advantageous in that it serves to precisely locate the changing bag and associated encircling wire loop in its operational location on the side of the paper machine. The wire 20 may thereafter be pulled into the paper machine as described above.

It is preferred to inflate the changing bag 10 utilizing an air blower which need only be supplied with relatively low pressure air. Further, it is preferred to utilize suction apparatus in connection with the deflation of the bag in order to increase the speed of this operation.

It should be noted that other arrangements than the illustrated preferred embodiment may be utilized in connection with the practice of the method and apparatus of the present invention. For example, several parallel or consecutive changing bags may be utilized in lieu of the single changing bag illustrated in the preferred embodiment. In such case, the combination of several changing bags will function as a unit in a manner similar to that described in connection with the illustrated embodiment. This arrangement is advantageous in that the handling of smaller bags of somewhat easier than handling a single large bag.

Obviously, numerous modifications and variations of the present invention are possible in the light of the above teachings. Accordingly, it is understood that within the scope of the appended claims the invention may be practiced otherwise than is specifically disclosed herein.

What is claimed is:

1. An inflatable changing bag for use with a paper making machine, namely, for use in connection with changing a fabric loop thereof having a run with a certain configuration, comprising an inflatable bag which, upon being inflated, has a vertical cross-sectional configuration in the machine direction which is substantially the same as said certain configuration of the run of said fabric loop to be changed, said inflatable bag having a plurality of substantially vertical partitions provided in its interior extending in the machine direction, said partitions defining a plurality of airtight compartments within said bag, each compartment being provided with valve means for deflating each compartment independently of the other compartments.

2. Apparatus as recited in claim 1 wherein said changing bag has at least two through bores provided therein whereby elongate members may be inserted therethrough for supporting said bag upon inflation.

3. Apparatus as recited in claim 1 wherein the changing bag has upper and lower walls and wherein at least one of the upper and lower walls have transversely extending grooves formed therein.

4. Apparatus as recited in claim 1 wherein the interior compartment defining the side surface of the bag adapted to be located adjacent to the paper machine during the introduction of the fabric loop has a vertical height which is less than the vertical height of the remainder of said compartments thereby defining a downwardly facing shelf surface, whereby upon locating the changing bag adjacent to the paper machine, said shelf surface is locatable on and supportable by a servicing platform provided on the paper machine.

* * * * *